US011156113B2

(12) United States Patent
Stimpson et al.

(10) Patent No.: US 11,156,113 B2
(45) Date of Patent: Oct. 26, 2021

(54) TURBINE NOZZLE COMPLIANT JOINTS AND ADDITIVE METHODS OF MANUFACTURING THE SAME

(71) Applicant: HONEYWELL INTERNATIONAL INC., Morris Plains, NJ (US)

(72) Inventors: Curtis Stimpson, Gilbert, AZ (US); Mark Morris, Phoenix, AZ (US); Morgan Mader, Chandler, AZ (US); Shannon Biery, Scottsdale, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 16 days.

(21) Appl. No.: 16/743,232

(22) Filed: Jan. 15, 2020

(65) Prior Publication Data

US 2021/0215054 A1 Jul. 15, 2021

(51) Int. Cl.
*F01D 11/00* (2006.01)
*F01D 9/02* (2006.01)

(52) U.S. Cl.
CPC ..... *F01D 9/023* (2013.01); *F01D 11/006* (2013.01); *F05D 2220/32* (2013.01); *F05D 2240/128* (2013.01)

(58) Field of Classification Search
CPC ..... F01D 9/023; F01D 11/006; F01D 9/04; F05D 2220/32; F05D 2240/128
See application file for complete search history.

(56) References Cited

U.S. PATENT DOCUMENTS 2,332,330 A * 10/1943 McMahan ..... B22D 19/04 164/98
4,664,609 A * 5/1987 Kaneda ..... F01C 21/0809 164/108
4,869,645 A * 9/1989 Verpoort ..... B22D 19/00 416/241 R
4,955,423 A * 9/1990 Blazek ..... B22C 9/04 164/10
5,069,265 A * 12/1991 Blazek ..... B22C 9/04 164/35
5,290,143 A * 3/1994 Kington ..... F01D 9/044 415/191

(Continued)

FOREIGN PATENT DOCUMENTS

EP 3167983 A2 5/2017

OTHER PUBLICATIONS

Parker Aerospace Gas Turbine Fuel Systems Division, Additive Manufacturing and Engineering Solve Aerospace Challenges, Jun. 6, 2019.

*Primary Examiner* — Justin D Seabe
*Assistant Examiner* — Theodore C Ribadeneyra
(74) *Attorney, Agent, or Firm* — Lorenz & Kopf, LLP

(57) ABSTRACT

A turbine nozzle formed of a superalloy, and including: an annular end-wall including a pocket, the pocket defining an inner surface within the annular end-wall; a vane, the vane including an airfoil portion and a boss portion, the vane extending from the pocket such that the boss portion is enclosed within the pocket and the airfoil portion extends through the annular end-wall; and a seal within the pocket, the seal including one or more protrusions extending from the inner surface of the pocket and abutting the vane at one or both of the boss portion and the airfoil portion.

9 Claims, 6 Drawing Sheets

(56) References Cited

U.S. PATENT DOCUMENTS 5,332,360 A * 7/1994 Correia ..... F01D 9/042 29/889.21
5,797,725 A * 8/1998 Rhodes ..... B23P 6/005 415/209.2
6,409,473 B1 * 6/2002 Chen ..... F01D 5/225 415/191
8,047,771 B2 11/2011 Tucker et al.
8,257,038 B2 * 9/2012 James ..... F01D 9/044 415/215.1
8,276,649 B2 10/2012 Gagnon, Jr. et al.
8,474,267 B2 7/2013 Nager
8,668,442 B2 3/2014 Morris et al.
8,926,262 B2 * 1/2015 Tanahashi ..... F01D 11/005 415/9
8,998,566 B2 * 4/2015 Justl ..... F01D 11/005 415/116
9,169,736 B2 * 10/2015 Hayford ..... F01D 9/042
9,611,748 B2 4/2017 Kington et al.
9,702,252 B2 7/2017 Kanjiyani et al.
9,726,028 B2 * 8/2017 Marra ..... B22D 19/0072
9,803,486 B2 * 10/2017 Freeman ..... C04B 37/005
9,885,245 B2 2/2018 Crosatti et al.
9,951,639 B2 * 4/2018 Ivakitch ..... F01D 11/005
9,970,307 B2 5/2018 Kanjiyani et al.
9,988,932 B2 6/2018 Riahi et al.
10,184,344 B2 1/2019 Roberts et al.
10,253,643 B2 4/2019 Kerns et al.
10,294,807 B2 * 5/2019 Kington ..... C04B 35/80
10,337,337 B2 * 7/2019 Brandl ..... F01D 5/3007
10,378,373 B2 8/2019 Reynolds et al.
10,655,482 B2 * 5/2020 Freeman ..... F01D 9/044
10,655,486 B2 * 5/2020 Bulot ..... F01D 11/005
2011/0243724 A1 * 10/2011 Campbell ..... F01D 9/044 415/208.2
2011/0297344 A1 * 12/2011 Campbell ..... B22D 19/00 164/98
2012/0003086 A1 1/2012 Morris et al.
2015/0267550 A1 9/2015 Kanjiyani et al.
2016/0265780 A1 9/2016 Patel et al.
2016/0348216 A1 12/2016 Szuromi et al.
2018/0368984 A1 12/2018 Kieser et al.
2019/0063238 A1 2/2019 Bulot et al.
2019/0128131 A1 5/2019 Sener et al.

* cited by examiner

TURBINE NOZZLE COMPLIANT JOINTS AND ADDITIVE METHODS OF MANUFACTURING THE SAME

TECHNICAL FIELD

The present disclosure generally relates to the design and manufacture of components for gas turbine engines, particularly to turbine nozzles. More specifically, the present disclosure relates to compliant joint designs for turbine nozzles and additive manufacturing processes for the same.

BACKGROUND

A gas turbine engine includes a compressor, a combustor, and a turbine. The compressor provides compressed air to the combustor. The combustor mixes the compressed air with fuel, ignites the mixture, and provides combustion gases to the turbine. The turbine extracts energy from the combustion gases. The turbine includes one or more stages with each stage having an annular turbine nozzle and a plurality of rotor blades. The turbine nozzle channels the combustion gases to the rotor blades and the rotor blades extract energy from the combustion gases. The turbine nozzle includes a plurality of circumferentially spaced stator vanes (airfoils) positioned between and attached to radially inner and outer bands (end-walls). The circumferentially spaced vanes define converging channels there between through which the combustion gases are turned and accelerated toward the rotor blades.

The vanes of the turbine nozzle are subject to transient thermal cycling. Turbine vanes may sustain damage due to cracking from low-cycle fatigue (LCF) and thermo-mechanical fatigue (TMF). As the vanes heat up, they expand. LCF and TMF occur when stresses develop from the differential expansion rates of the airfoils and end-walls. Thick-to-thin wall thickness transitions, which are encountered on some turbine engine designs, may exacerbate LCF and TMF issues.

One prior art approach to mitigate LCF and TMF cracking is to decouple the airfoils from adjacent end-walls. However, this is difficult because airfoil aero loading requires a connection to the end-walls to transfer the loads. Two such exemplary prior art turbine vane constructions are: (1) designs where airfoils are attached to full end-wall rings, and (2) designs where one or more airfoils are attached to segmented end-walls that are then assembled into a full ring. The former (1) designs may have issues with LCF and TMF cracking because they lack any design features that reduce such failure mechanisms. In contrast, the latter (2) are less prone to LCF and TMF cracking but may have leakage between the segments, which may hurt specific fuel consumption (SFC) and may contribute to increased pattern factor at the combustor exit due to the allocation of cooling air that could be used for combustor cooling. Thus, the prior art designs that include an end-wall connection force a trade-off between component life and SFC.

Hence, there is a need for improved turbine nozzle designs that satisfy load-transfer requirements, yet that do not incur a penalty in either component life or SFC due to their end-wall configuration. It would additionally be desirable if such components could be manufactured using modern, rapid fabrication techniques, such as additive manufacturing. Furthermore, other desirable features and characteristics of the manufacturing methods disclosed herein will become apparent from the subsequent detailed description and the appended claims, taken in conjunction with the accompanying drawings and the preceding background.

BRIEF SUMMARY

This summary is provided to describe select concepts in a simplified form that are further described in the detailed description. This summary is not intended to identify key or essential features of the claimed subject matter, nor is it intended to be used as an aid in determining the scope of the claimed subject matter.

Disclosed herein, in one exemplary embodiment, is a turbine nozzle formed of a superalloy, and including: an annular end-wall including a pocket, the pocket defining an inner surface within the annular end-wall; a vane, the vane including an airfoil portion and a boss portion, the vane extending from the pocket such that the boss portion is enclosed within the pocket and the airfoil portion extends through the annular end-wall; and a seal within the pocket, the seal including one or more protrusions extending from the inner surface of the pocket and abutting the vane at one or both of the boss portion and the airfoil portion. Further disclosed herein are additive manufacturing methods for making such a turbine nozzle, as well as gas turbine engines that include such a turbine nozzle.

BRIEF DESCRIPTION OF THE DRAWING FIGURES

The present invention will hereinafter be described in conjunction with the following drawing figures, wherein like numerals denote like elements, and wherein.

Figure 4:
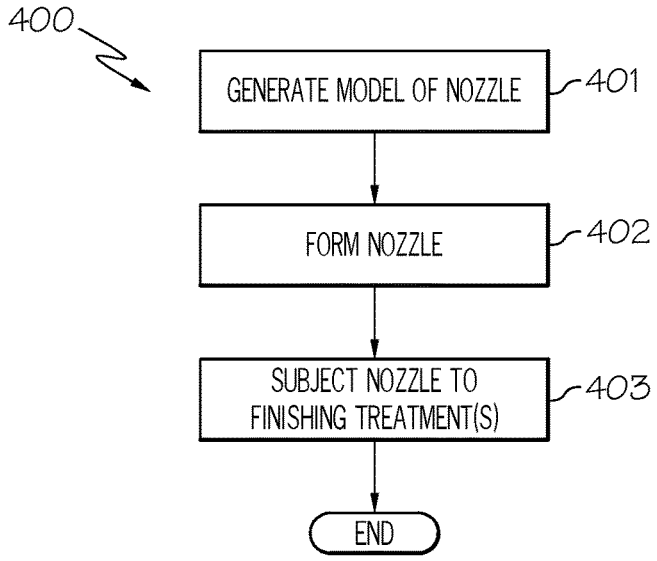
Figure 5:
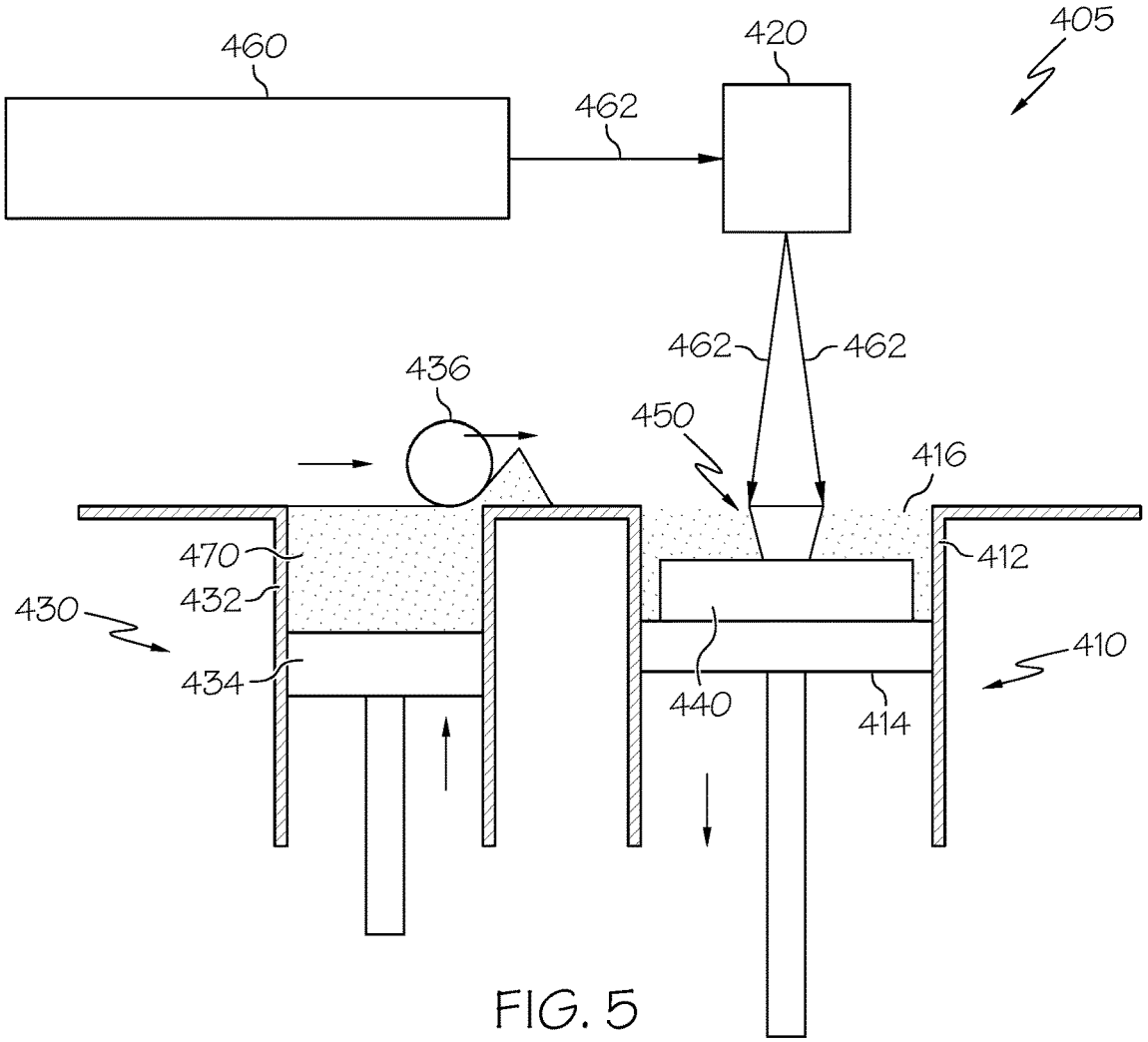
Figure 6:
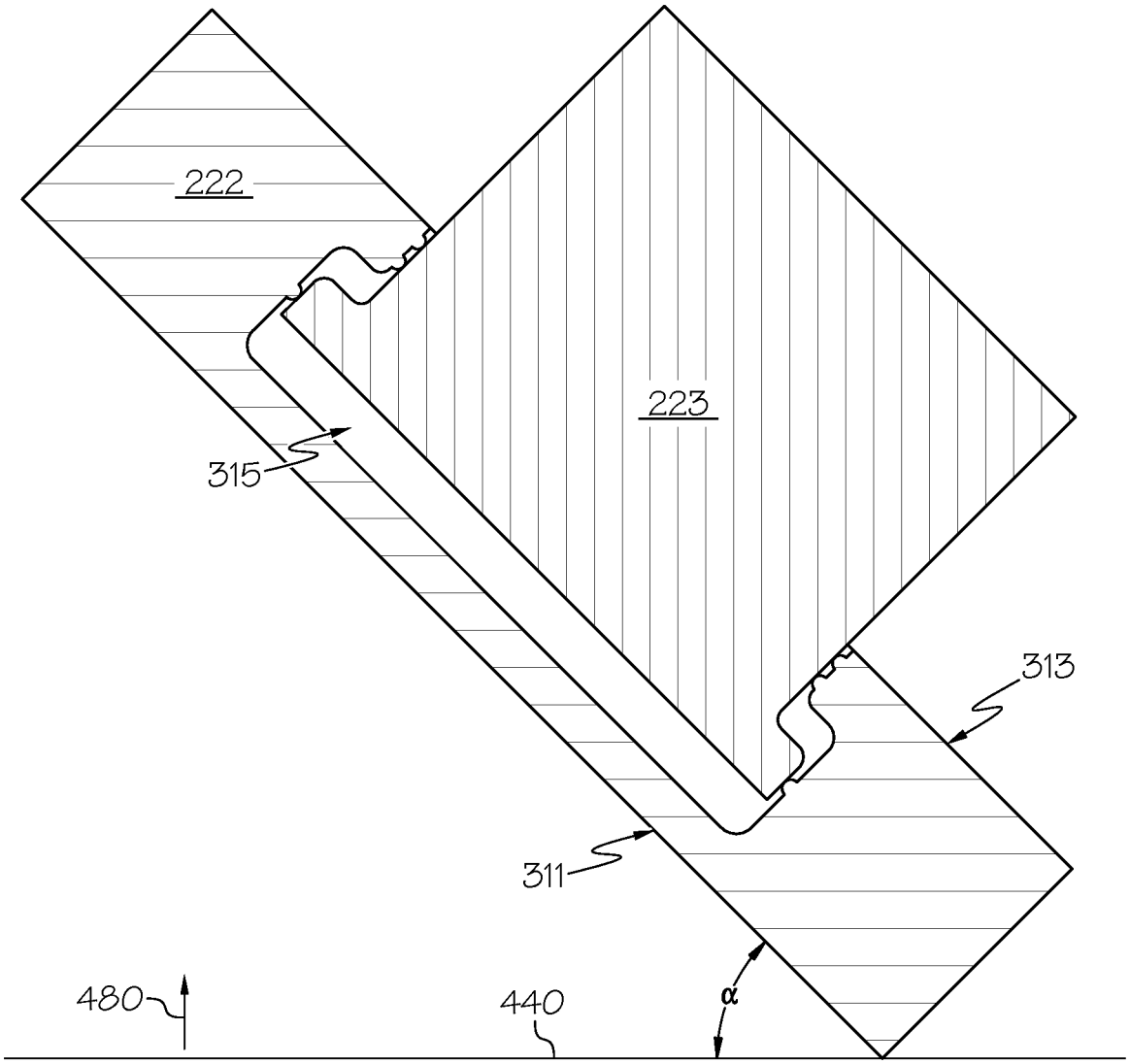

FIG. 4 provides a flowchart illustrating a method for manufacturing a turbine nozzle using additive manufacturing techniques, according to an exemplary embodiment;

FIG. 5 is a schematic view of an additive manufacturing system for manufacturing the turbine nozzle that is capable of operation in accordance with the method of FIG. 4; and FIG. 6 is a diagram representing an exemplary build direction suitable for manufacturing the turbine nozzle in connection with the method of FIG. 4 and the system of FIG. 5.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Unless specifically stated or obvious from context, as used herein, the term "about" is understood as within a range of normal tolerance in the art, for example within 2 standard deviations of the mean. "About" can be understood as within 10%, 5%, 1%, or 0.5% of the stated value. Unless otherwise clear from the context, all numerical values provided herein are modified by the term "about."

Before proceeding with the detailed description, it is to be appreciated that the described embodiments are not limited to use in conjunction with a particular type of turbine engine. Thus, although the present embodiments are, for convenience of explanation, depicted and described as being implemented in a multi-spool turbofan gas turbine jet engine, it will be appreciated that it can be implemented in various other types of turbine engines, and in various other systems and environments. Moreover, although the embodiments of the inventive subject matter are described as being implemented into a turbine section of the engine, it will be appreciated that the embodiments of the inventive subject matter may alternatively be used in any other section of the engine that may benefit from the inclusion of compliant joint configurations as described herein.

Figure 1:
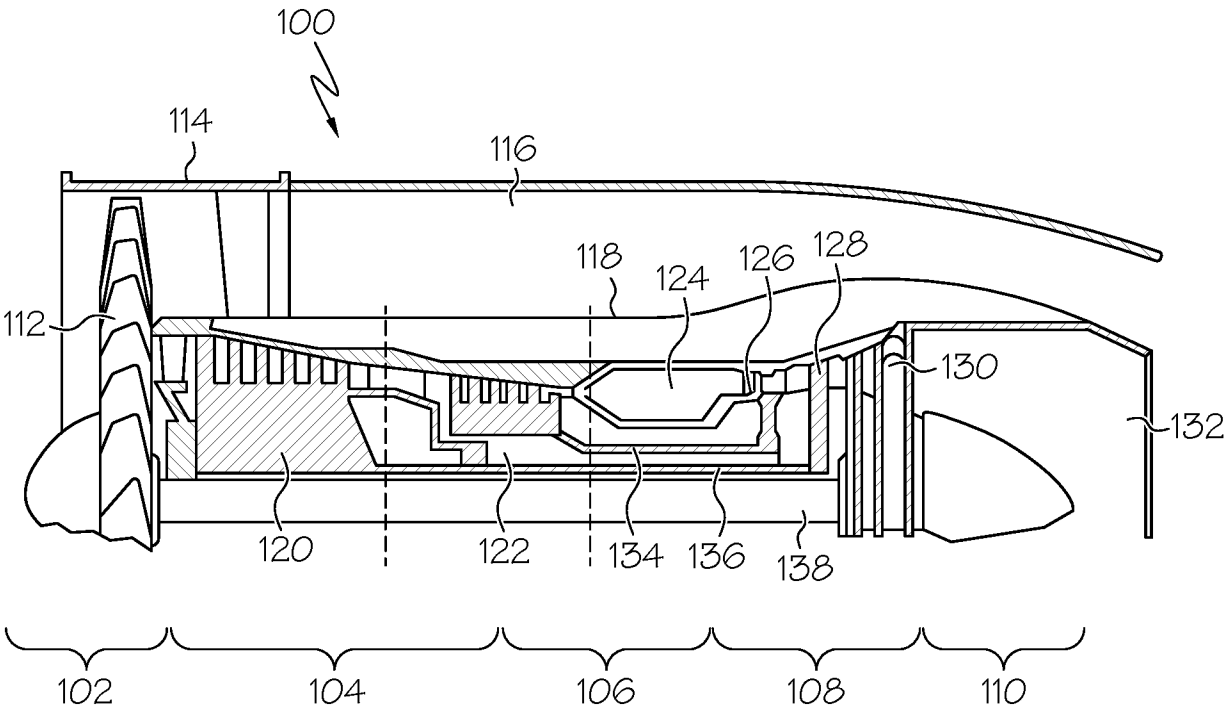
FIG. 1 is a simplified cross section side view of a gas turbine engine, according to an exemplary embodiment.

In this regard, FIG. 1 is a simplified, schematic of a gas turbine engine 100, according to an embodiment. The gas turbine engine 100 generally includes an intake section 102, a compressor section 104, a combustion section 106, a turbine section 108, and an exhaust section 110. The intake section 102 includes a fan 112, which is mounted in a fan case 114. The fan 112 draws air into the intake section 102 and accelerates it. A fraction of the accelerated air exhausted from the fan 112 is directed through a bypass section 116 disposed between the fan case 114 and an engine bypass duct 118, providing forward thrust. The remaining fraction of air exhausted from the fan 112 is directed into the compressor section 104.

The compressor section 104 includes an intermediate-pressure compressor 120 and a high-pressure compressor 122. The intermediate-pressure compressor 120 raises the pressure of the air directed into it from the fan 112, directing the compressed air into the high-pressure compressor 122. The high-pressure compressor 122 compresses the air still further, directing the high-pressure air into the combustion section 106. In the combustion section 106, which includes an annular combustor 124, the high-pressure air is mixed with fuel and combusted. The combusted air is then directed into the turbine section 108.

The turbine section 108 includes a high-pressure turbine 126, an intermediate-pressure turbine 128, and a low-pressure turbine 130 disposed in axial flow series. The combusted air from the combustion section 106 expands through the turbines 126, 128, 130 causing each to rotate. The air is then exhausted through a propulsion nozzle 132 disposed in the exhaust section 110, providing additional forward thrust. As each turbine 126, 128, 130 rotates, each drives equipment in the engine 100 via concentrically disposed shafts or spools. Specifically, the high-pressure turbine 126 drives the high-pressure compressor 122 via a high-pressure shaft 134, the intermediate-pressure turbine 128 drives the intermediate-pressure compressor 120 via an intermediate-pressure shaft 136, and the low-pressure turbine 130 drives the fan 112 via a low-pressure shaft 138.

Figure 2A:
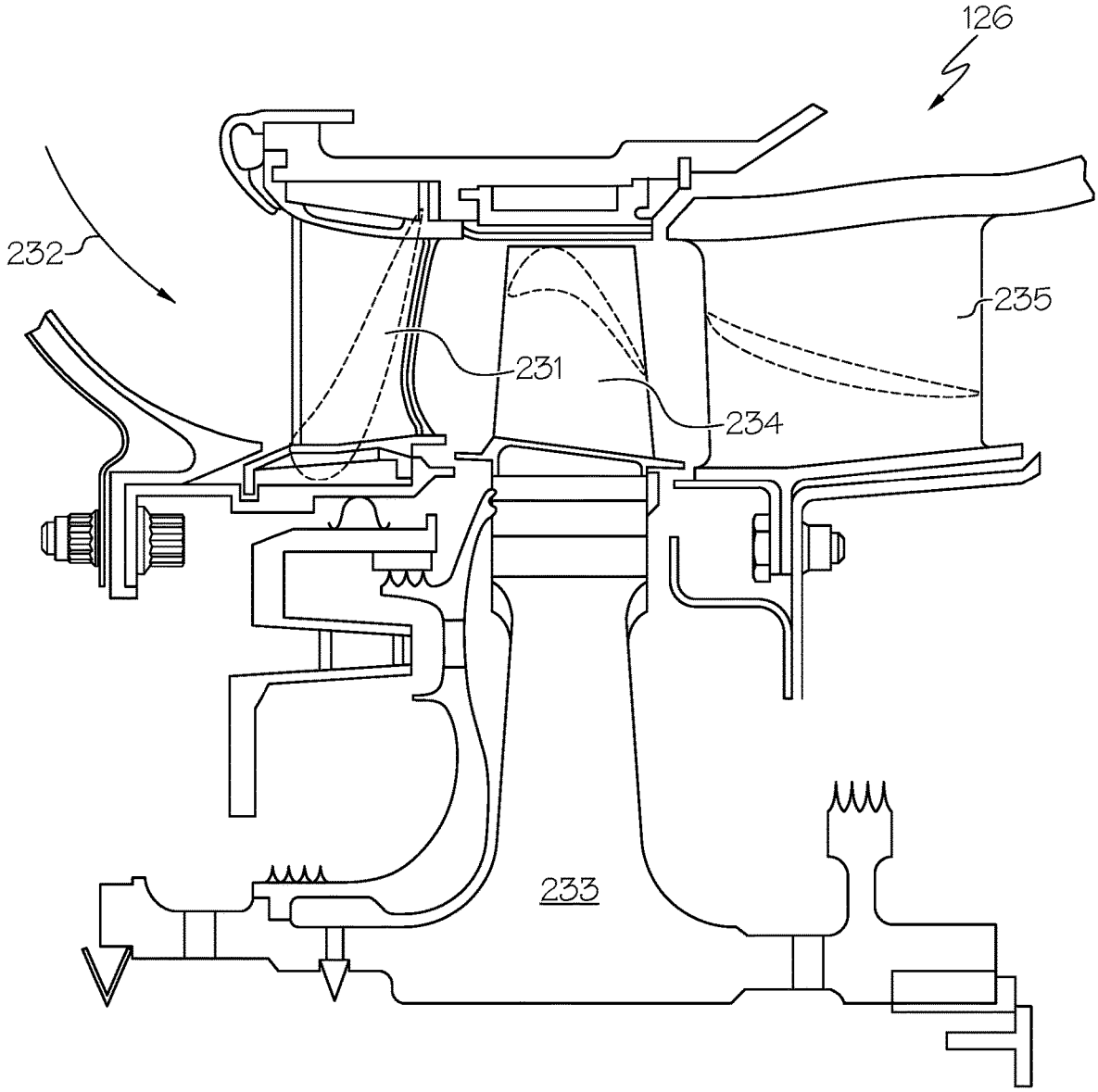
FIG. 2A is a cross-sectional view of a high-pressure turbine module, according to an exemplary embodiment.

The high-pressure turbine (HPT) module 126 is depicted in FIG. 2A, in greater detail. A turbine nozzle, such as but not limited to an HPT nozzle 231, may include any nozzle exposed to high temperatures. The nozzle may include materials such as nickel-base superalloy, cobalt-base superalloy, structural ceramic, silicon nitride, and silicon carbide. A combustor gas flow 232 may pass through the HPT nozzle 231 from the upstream combustor (124) to a downstream HPT rotor 233. Energy may be extracted from the combustor gas flow 232 by the HPT blades 234 of the HPT rotor 233. The combustor gas flow 232 may then flow downstream to a lower-pressure turbine nozzle 235, for example of intermediate pressure turbine 128.

Figure 2B:
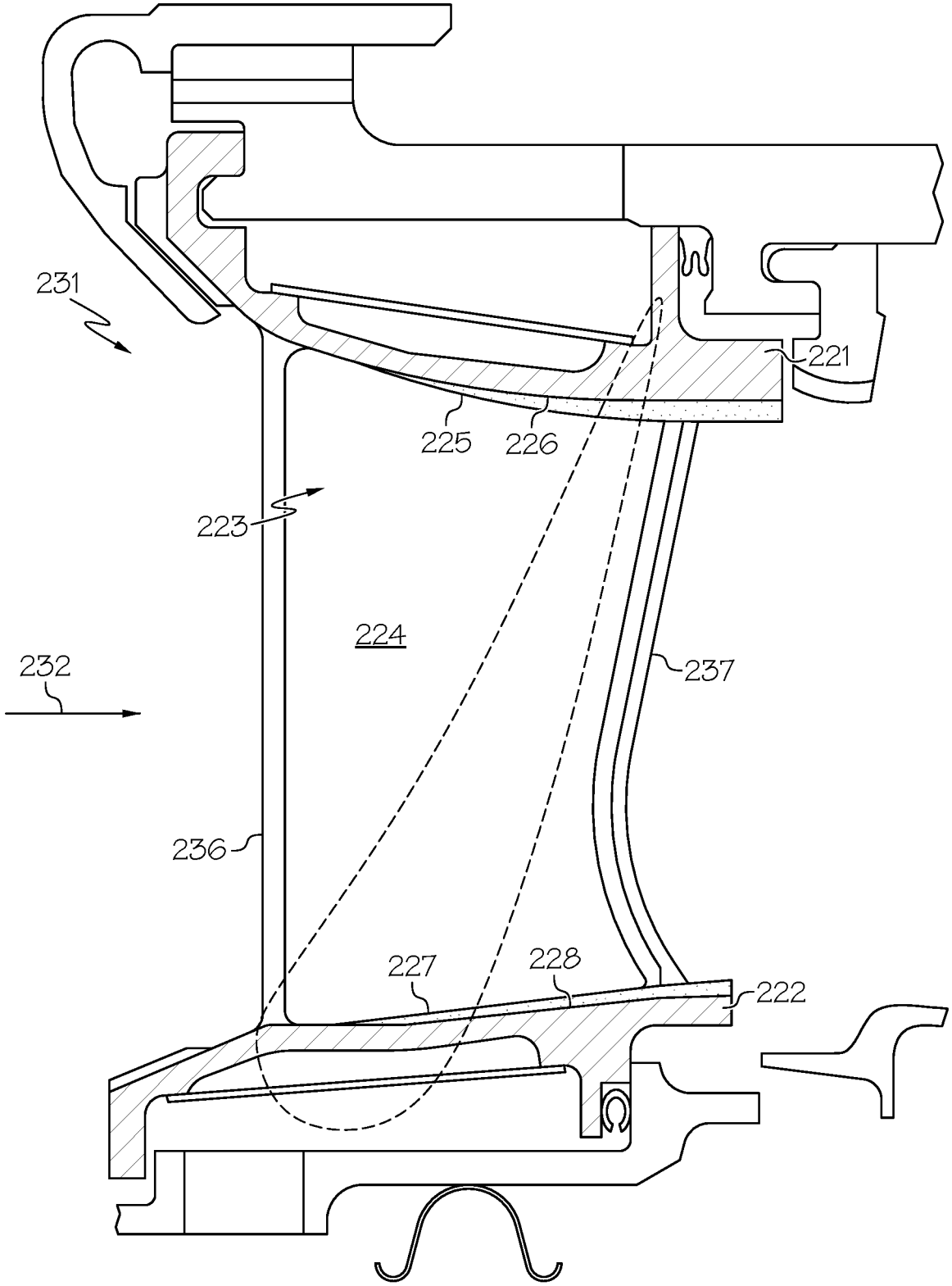
FIG. 2B is a close-up view of a turbine nozzle shown in the high-pressure turbine module of FIG. 2A.

The HPT nozzle 231 may include two end-walls, a nozzle outer end-wall 221 and a nozzle inner end-wall 222, as better seen in FIG. 2B. The end-walls 221 and 222 may be annular in shape and positioned such that they can support a plurality of circumferentially spaced nozzle vanes 223. For some applications, the nozzle outer end-wall 221 and the nozzle inner end-wall 222 optionally may be segmented to relieve thermal stresses during engine operation, as initially discussed above. Each nozzle vane 223 may comprise a radially outward end 225 and a radially inward end 227. The radially outward end 225 of the nozzle vane may be in contact with a radially inward side 226 of the nozzle outer end-wall 221. The radially inward end 227 of the nozzle vane may be in contact with a radially outward side 228 of the nozzle inner end-wall 222. The circumferentially spaced nozzle vanes 223, along with the end-walls 221 and 222, may define a plurality of nozzle openings 224 through which the combustor gas flow 232 may be turned and accelerated toward the HPT blades 234. Each nozzle opening 224 may be a volume defined by adjacent nozzle vanes 223, a nozzle outer end-wall 221 and a nozzle inner end-wall 222. Each nozzle vane 223 may have an airfoil cross-section with a leading edge 236 and a trailing edge 237.

The turbine nozzle 231 illustrated in FIGS. 2A and 2B, as described above, further includes a new configuration utilizing recent advances in additive manufacturing to reduce mechanical stresses in turbine vane airfoil-to-end-wall joints (221/223 and 222/223). In addition, it enables improved sealing since full ring designs (221 and 222) may be employed as opposed to segmented vane designs. Embodiments of the present disclosure are therefore expected to reduce LCF and TMF cracking over the prior art and increase resulting engine service intervals without incurring penalties on SFC. In particular, the embodiments presented herein propose utilizing recent advances in additive manufacturing (AM) to decouple the radial growths and subsequent binding of the airfoils (223) from the adjacent end-walls (221/222). As such, the present methods and designs allow for the fabrication of vanes (223) and their neighboring end-walls (221/222) in one build—adding geometric complexity without incurring additional fabrication cost in the process.

Figure 3:
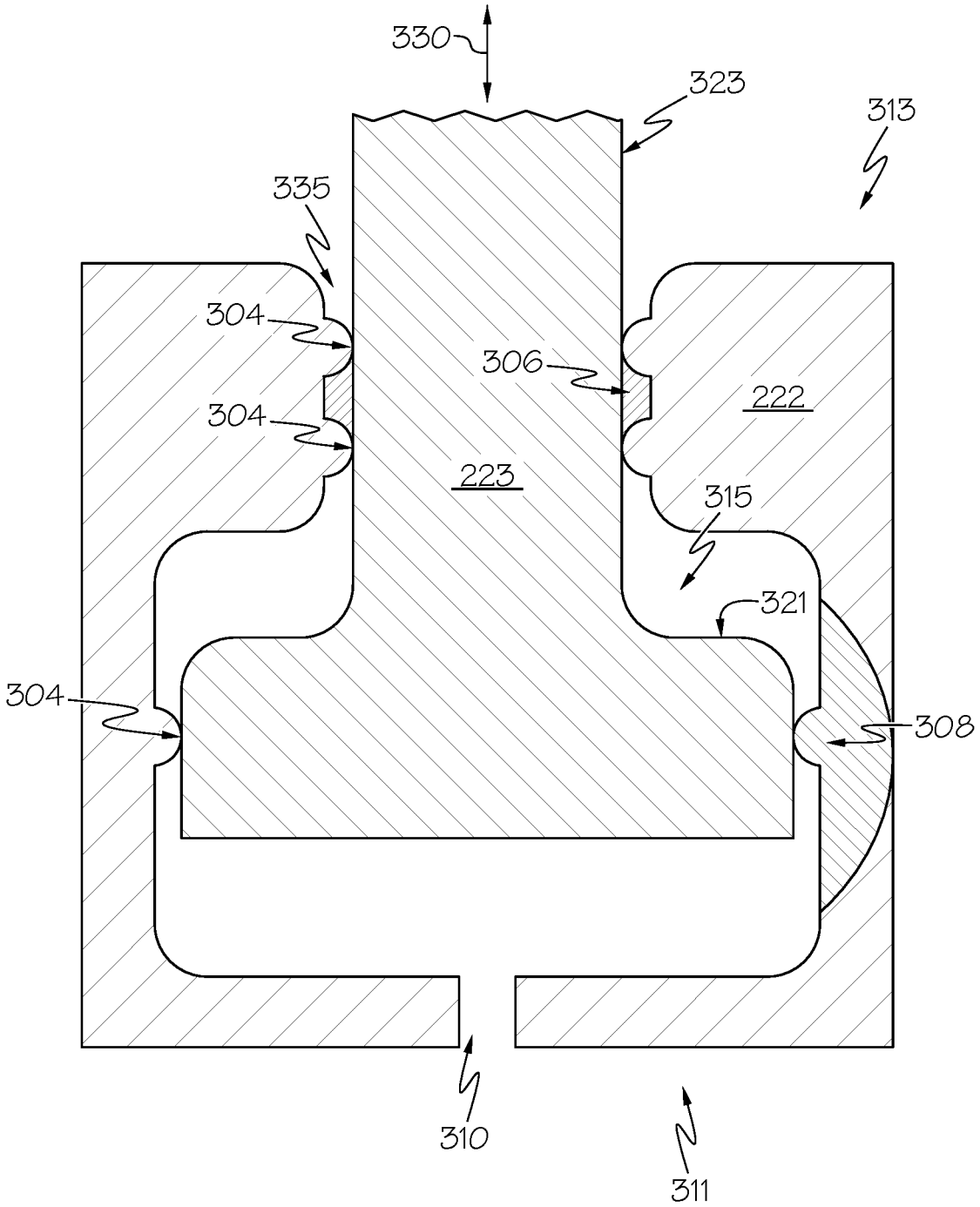
FIG. 3 is a cross-sectional view showing a turbine nozzle compliant joint, according to an exemplary embodiment.

In particular, turning now to FIG. 3, illustrated is a cross-sectional view showing the proposed turbine nozzle compliant joint according to the practice of this disclosure, in an embodiment. FIG. 3 illustrates a cross-section through the radially-inner end-wall 222 and a portion of the nozzle airfoil/vane 223. The end-wall 222 has a radially inner portion 311 and a radially outer portion 313. Disposed between the inner portion 311 and the outer portion 313 is a cavity or pocket 315. The cavity or pocket 315 is configured to enclose a boss portion 321 of the vane 223. The boss portion 321 extends from the airfoil portion of the vane 323, and the boss portion 321 has greater dimensions in either the axial and/or circumferential directions with respect to the vane airfoil portion 323. The vane airfoil portion 323 extends through the radially outer portion 313, which includes an airfoil opening 335 that has a similar cross-section to the airfoil portion 323 to allow the airfoil portion 323 to pass therethrough. Thus, given its larger dimensions, the boss portion 321 is not able to pass through the airfoil opening 335, whereas the airfoil portion 323 is, and the boss portion remains enclosed within the cavity or pocket 315.

As such, one structural feature of the present nozzle slip joint is that the boss portion 321 is provided at a base of the airfoil portion 323 of vane 223, and further that the cavity or pocket 315 in the end-wall 222 fits the boss portion 321. The boss portion 321 serves to capture the airfoil/vane 223 so it cannot be separated from the end-wall 222. (It should also be noted that these same features may be provided for outer radial end-wall 221, except everything in a reverse radial orientation.) This structural feature is desirable to prevent a portion of the vane 223 from being liberated and sending debris into downstream rotating components in case the vane 223 oxidizes or cracks completely through the entire midspan. If this failure mechanism is not a concern for a certain vane design, an alternate embodiment of the present disclosure could omit the boss portion 321 and simply have the airfoil portion 323 extended into the cavity or pocket 315 in the end-wall 222.

Furthermore, the present disclosure utilizes the ability of AM to produce very thin gaps between adjacent solid bodies which enables a sealed and compliant joint between two pieces. In particular, the airfoil opening 335 at the outer portion 313 includes a sealing feature 304, which is embodied in the non-limiting example of FIG. 3 as a plurality of protrusions from the end-wall 222 that have a semicircular cross-section. Likewise, as shown, the cavity or pocket 315 has protrusions extending therefrom, as part of the sealing feature 304. In other embodiments, there may be more or fewer protrusions; the protrusions may be of different shapes; the protrusions may be in a different configuration; and, the protrusions may vary in shape/size with respect to one another. In any event, the sealing feature 304 is initially fused to the airfoil portion 323 and/or the boss portion 321 with a radial thickness of only a few mils. The fusion can be fully fused or only partially fused where porosity may exist at the interface between the sealing feature 304 and the airfoil portion 323. Upon completion of fabrication, the fused seals of sealing feature 304 can be separated from the vane 223 by mechanically or thermally loading the component at which point the joint slides, as indicated by arrow 330 in FIG. 3 (the sealing feature 304 thereafter physically abuts but is no longer metallurgically integral with the vane 223).

As further illustrated in FIG. 3, between the seals of feature 304 may be captured powder 306. The powder is a result of the layer-by-layer building of the AM process used to manufacture the nozzle, as will be discussed in greater detail below. The powder 306 in the joint may also improve the effectiveness of the seal. In some embodiments, a gap enclosing captured powder 306 may have an average size of about 0.001" to about 0.007", such as about 0.004". As illustrated, such a gap that would enclose powder (306) may only be present adjacent to the airfoil portion 323 (at opening 335), and not the boss portion 321 (at pocket/cavity 315). For example, the portion of sealing feature 304 adjacent the boss portion 321 may serve one or more purposes, for example: (1) to provide a secondary seal to minimize the likelihood of ingestion of hot gases into the joint cavities (315), and (2) provide resistance to any moment that might cause the airfoil/vane 223 to tend to rotate.

Still further with regard to FIG. 3, some features shown therein facilitate the fabrication of the nozzle. First, there may be one or more channels 308 along/through the end-wall 222 at the cavity or pocket 315, such channels 308 allowing a "bypass" of any portion of the sealing feature 304 that may be adjacent to the boss portion 321. In some embodiments, this channel feature 308 may be desirable to allow flow of trapped powder in the upper cavity (portion of pocket 315 radially outward from boss portion 321) to the lower cavity (portion of pocket 315 radially inward from boss portion 321). One or more small holes 310 in the radially inner portion 311 of the end-wall 222 allow the powder to escape the part, for example.

As initially noted above, manufacturing of the above-described turbine nozzle designs is adapted for use in additive manufacturing processes to form net or near-net shaped components, namely nozzles. As such, in accordance with an exemplary embodiment, FIG. 4 provides a flowchart illustrating a method 400 for manufacturing a nozzle using, in whole or in part, powder bed additive manufacturing techniques based on various high energy density energy beams. In a first step 401, a model, such as a design model, of the nozzle may be defined in any suitable manner. For example, the model may be designed with computer aided design (CAD) software and may include three-dimensional ("3D") numeric coordinates of the entire configuration of the component including both external and internal surfaces. In one exemplary embodiment, the model may include a number of successive two-dimensional ("2D") cross-sectional slices that together form the 3D component. The model may conform with FIGS. 2A, 2B, and 3, as described above.

In step 402 of the method 400, the component is formed according to the model of step 401. In one exemplary embodiment, a portion of the component is formed using a rapid prototyping or additive layer manufacturing process. In other embodiments, the entire component is formed using a rapid prototyping or additive layer manufacturing process.

Some examples of additive layer manufacturing processes include: direct metal laser sintering (DMLS), in which a laser is used to sinter a powder media in precisely controlled locations; laser wire deposition in which a wire feedstock is melted by a laser and then deposited and solidified in precise locations to build the product; electron beam melting; laser engineered net shaping; and selective laser melting. In general, powder bed additive manufacturing techniques provide flexibility in free-form fabrication without geometric constraints, fast material processing time, and innovative joining techniques. In one particular exemplary embodiment, DMLS is used to produce the nozzle in step 402. DMLS is a commercially available laser-based rapid prototyping and tooling process by which complex parts may be directly produced by precision sintering and solidification of metal powder into successive layers of larger structures, each layer corresponding to a cross-sectional layer of the 3D component.

Prior to a discussion of the subsequent method steps of FIG. 4, reference is made to FIG. 5, which is a schematic view of an AM system 405 for manufacturing the component. The system 405 includes a fabrication device 410, a powder delivery device 430, a scanner 420, and a low energy density energy beam generator, such as a laser 460 (or an electron beam generator in other embodiments) that function to manufacture the article 450 (e.g., the nozzle-in-process) with build material 470. The fabrication device 410 includes a build container 412 with a fabrication support 414 on which the article 450 is formed and supported. The fabrication support 414 is movable within the build container 412 in a vertical direction and is adjusted in such a way to define a working plane 416. The delivery device 430 includes a powder chamber 432 with a delivery support 434 that supports the build material 470 and is also movable in the vertical direction. The delivery device 430 further includes a roller or wiper 436 that transfers build material 470 from the delivery device 430 to the fabrication device 410.

During operation, a base block 440 may be installed on the fabrication support 414. The fabrication support 414 is lowered and the delivery support 434 is raised. The roller or wiper 436 scrapes or otherwise pushes a portion of the build material 470 from the delivery device 430 to form the working plane 416 in the fabrication device 410. The laser 460 emits a laser beam 462, which is directed by the scanner 420 onto the build material 470 in the working plane 416 to selectively fuse the build material 470 into a cross-sectional layer of the article 450 according to the design. More specifically, the speed, position, and other operating parameters of the laser beam 462 are controlled to selectively fuse the powder of the build material 470 into larger structures by rapidly melting the powder particles that may melt or diffuse into the solid structure below, and subsequently, cool and re-solidify. As such, based on the control of the laser beam 462, each layer of build material 470 may include un-fused and fused build material 470 that respectively corresponds to the cross-sectional passages and walls that form the article 450. In general, the laser beam 462 is relatively low power, but with a high energy density, to selectively fuse the individual layer of build material 470. As an example, the laser beam 462 may have a power of approximately 50 to 500 Watts, although any suitable power may be provided.

Upon completion of a respective layer, the fabrication support 414 is lowered and the delivery support 434 is raised. Typically, the fabrication support 414, and thus the article 450, does not move in a horizontal plane during this step. The roller or wiper 436 again pushes a portion of the build material 470 from the delivery device 430 to form an additional layer of build material 470 on the working plane 416 of the fabrication device 410. The laser beam 462 is movably supported relative to the article 450 and is again controlled to selectively form another cross-sectional layer. As such, the article 450 is positioned in a bed of build material 470 as the successive layers are formed such that the un-fused and fused material supports subsequent layers. This process is continued according to the modeled design as successive cross-sectional layers are formed into the completed desired portion, e.g., the nozzle of step 402. It may also be noted that, in one embodiment of performing build step 402, the build direction may be preferentially in the angle/orientation alpha as shown in FIG. 6, with build angle alpha being between about 30 and about 60 degrees (for example about 45 degrees) and the build direction being in that of arrow 480. This angle/orientation may minimize the need for supports and may minimize the amount of down-skin in critical regions.

Returning to FIG. 4, at the completion of step 402, the article 450 (e.g., nozzle-in-process), is removed from the powder bed additive manufacturing system (e.g., from the AM system 405) and then may be given a stress relief treatment. In step 403, the component formed in step 402 may undergo finishing treatments. Such treatments include annealing and/or hot isostatic pressing (HIP), for example. Additionally, encapsulation of the component may be performed in some embodiments as part of step 403. Such encapsulation layers may be subsequently removed or maintained to function as an oxidation protection layer. Other finishing treatments that may be performed as a part of step 403 include aging, quenching, peening, polishing, or applying coatings. Further, if necessary, machining may be performed on the component to achieve a desired final shape.

Accordingly, the present disclosure has provided various embodiments of new turbine nozzles utilizing recent advances in additive manufacturing to reduce mechanical stresses in turbine vane airfoil-to-end-wall joints. In addition, the disclosure enables improved sealing since full ring designs may be employed as opposed segmented vane designs. Embodiments of the present disclosure are therefore expected to reduce LCF and TMF cracking over the prior art and increase resulting engine service intervals without incurring penalties on SFC.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

What is claimed is:

1. A turbine nozzle formed of a superalloy, the turbine nozzle being formed utilizing additive layer manufacturing techniques, the turbine nozzle comprising:

an annular end-wall comprising a pocket, the pocket defining an inner surface within the annular end-wall;

a vane, the vane comprising an airfoil portion and a boss portion, the vane extending from the pocket such that the boss portion is enclosed within the pocket and the airfoil portion extends through the annular end-wall; and a seal within the pocket, the seal comprising one or more protrusions extending from the inner surface of the pocket and abutting the vane at one or both of the boss portion and the airfoil portion, wherein the seal is provided at least adjacent to the airfoil portion, wherein the seal that is provided adjacent to the airfoil portion comprises a plurality of annular rings that abut the airfoil portion, and wherein powder material from the additive layer manufacturing process is entrapped in a gap defined between respective ones of the plurality of annular rings of the seal.

2. The turbine nozzle of claim 1, wherein the annular end-wall is either an inner annular end-wall or an outer annular end-wall.

3. The turbine nozzle of claim 1, wherein the annular end-wall comprises an airfoil opening adjacent to the pocket through which the airfoil portion extends.

4. The turbine nozzle of claim 1, wherein the gap has a spacing between respective ones of the plurality of annular rings of the seal of about 1 mil to about 7 mils.

5. The turbine nozzle of claim 1, wherein the seal physically abuts but is not metallurgically integral with the vane.

6. A gas turbine engine comprising the turbine nozzle of claim 1.

7. A turbine nozzle formed of a superalloy, the turbine nozzle comprising:

an annular end-wall comprising a pocket, the pocket defining an inner surface within the annular end-wall;

a vane, the vane comprising an airfoil portion and a boss portion, the vane extending from the pocket such that the boss portion is enclosed within the pocket and the airfoil portion extends through the annular end-wall; and a seal within the pocket, the seal comprising one or more protrusions extending from the inner surface of the pocket and abutting the vane at one or both of the boss portion and the airfoil portion, wherein the seal is provided at least adjacent to the boss portion, wherein the seal that is provided adjacent to the airfoil portion comprises at least one annular ring that abuts the boss portion, and wherein the pocket comprises a channel that bypasses the seal that is provided adjacent to the boss portion.

8. The turbine nozzle of claim 7, further comprising a hole in the annular end-wall leading to an annular end of the pocket opposite that of the airfoil portion extension.

9. A gas turbine engine comprising the turbine nozzle of claim 7.

* * * * *